US005899511A

United States Patent [19]

Dinatale

[11] Patent Number: 5,899,511

[45] Date of Patent: May 4, 1999

[54] BALL RETRIEVAL DEVICE MOUNTABLE UPON END OF GRIP OF GOLF CLUB

[76] Inventor: Regis C. Dinatale, 260 Saxony Ct., Winter Springs, Fla. 32708

[21] Appl. No.: 09/001,230

[22] Filed: Dec. 30, 1997

[51] Int. Cl.[6] ..... A63B 47/02

[52] U.S. Cl. ..... 294/19.2; 473/286

[58] Field of Search ..... 294/19.1, 19.2, 294/55, 66.1; 473/286

[56] References Cited

U.S. PATENT DOCUMENTS

| | | | |
|---|---|---|---|
| 2,801,875 | 8/1957 | McEvoy . | |
| 3,922,026 | 11/1975 | Schweitzer | 294/19.2 |
| 4,441,837 | 4/1984 | Mastroni . | |
| 4,515,402 | 5/1985 | Sedan . | |
| 4,733,681 | 3/1988 | Lee . | |
| 5,188,409 | 2/1993 | Forey | 294/19.2 |
| 5,230,385 | 7/1993 | Dinatale | 473/286 |
| 5,423,584 | 6/1995 | Pasternak | 294/19.2 |
| 5,437,449 | 8/1995 | Zink | 473/286 |
| 5,520,389 | 5/1996 | Furrow | 294/19.2 |

FOREIGN PATENT DOCUMENTS

| | | | |
|---|---|---|---|
| 2074926 | 11/1981 | United Kingdom | 294/19.2 |

*Primary Examiner*—Dean Kramer
*Attorney, Agent, or Firm*—Julian C. Renfro, Esq.

[57] ABSTRACT

An elongate ball-retrieving device adapted for being connected in an end-to-end relationship with the handle end of a golf club, such that the golf club, when moved into a substantially aligned relationship with the elongate device, can advantageously serve to increase the effective length of the ball-retrieving device. One end of the elongate device is equipped with a cup usable for retrieving a golf ball lodged in a relatively inaccessible location, with the end of the elongate device opposite the cup having an upwardly-opening handle-receiving chamber bounded by a closely spaced pair of inwardly biased, handle-contacting fingers. These fingers are of resilient construction, with the spacing between the pair of fingers being less than the width of the handle to be received therebetween. Therefore, upon the end of the club handle being inserted into the upwardly-opening chamber and between the fingers, the fingers are forced apart, with the fingers thereafter reclosing around the handle and serving to tightly hold the club handle in aligned relationship with the elongate device.

13 Claims, 2 Drawing Sheets

BALL RETRIEVAL DEVICE MOUNTABLE UPON END OF GRIP OF GOLF CLUB

BACKGROUND OF THE INVENTION

In the past a number of patents have been issued upon devices concerned with the retrieval of a golf ball from a relatively inaccessible location.

The McEvoy U.S. Pat. No. 2,801,875 entitled "Golf Ball Retriever" makes clear that it is well known in the art to have a golf ball retriever that is removably attached to the handle of a golf club. However, the McEvoy device is quite short, and would not be of a length sufficient to enable a golfer to retrieve a golf ball relatively far out into the water of a pond or the like. Also, the McEvoy device is of elaborate construction, so it would necessarily be quite expensive to construct and to purchase.

The Mastroni U.S. Pat. No. 4,441,837 entitled "Golf Club Coupling Assembly" reveals a mechanical assembly enabling the handles of two golf clubs to be joined together, so that one club can be held in the hand, and the other club used for retrieving a golf ball. Obviously the use of the second club for retrieving a golf ball is greatly inferior to a ball retriever enabling a golf ball to actually be picked up, and this coupling device, like the McEvoy patent, would necessarily be expensive to make and would obviously be costly for a golfer to purchase.

With regard to the Sedan U.S. Pat. No. 4,515,402 entitled "Golf Ball Retriever", you will note that this patent shows an elongate structure having one loop for fitting over the handle of a golf club and a second loop for fitting over the club head, with a golf ball grasping structure 14 at the remote end for engaging the ball to be retrieved.

One significant disadvantage of the Sedan arrangement is the considerable amount of overlap involving the end of the retriever device opposite the cup 14, and the part of the golf club involving the face of the club. The overlap would appear to be on the order of at least one foot, meaning that a total of two feet has been lost insofar as involves the effective length of the Sedan Golf Ball Retriever interacting with the golf club.

The Lee U.S. Pat. No. 4,733,681 entitled "Combination Device of Umbrella and Golf Ball Retriever" is a bit different than the others in that instead of using a golf club, this patentee utilizes the handle end of an umbrella for supporting an elongate tube C, at the end of which is a golf ball engaging device E. However, a golfer will not necessarily have an umbrella of suitable length in his or her golf bag, and such an arrangement is far more inconvenient to use than is a golf club for extending the effective length of a ball retriever device. Furthermore, an inspection of FIGS. 3 through 6 of the Lee patent reveals that his device involves the use of complex and therefore expensive components.

The Forey U.S. Pat. No. 5,188,409 entitled "Golf Ball Retriever" shows a slotted sleeve 16 for engaging the handle of a golf club, so that the effective length of the retriever device will be increased. However, the Forey device is necessarily is of expensive construction in that each of the interfitting components of a telescoping nature must be manufactured to a high degree of tolerance if the interfitting parts are to operate together in a correct manner.

In addition, there is a significant amount of lost effective length inasmuch as the sleeve 16 will likely engage the handle of the golf club a number of inches away from the end of the handle, rather than engaging the very end of the handle, as is the case with the present invention.

It was to overcome the significant disadvantages of the prior art devices that the present invention was evolved.

SUMMARY OF THE INVENTION

In accordance with this invention I have provided a novel ball-retrieving device enabling a golf ball to be retrieved from a somewhat inaccessible location, such as shallow water or a clump of bushes. The highly advantageous arrangement described herein enables the golfer to avoid having to sacrifice balls that have landed in a location where they can be seen but not otherwise reached. My novel device comprises an elongate rod having at one end, a ball-receiving cup, and at the other end, handle-receiving means for releasably engaging the grip end of a golf club, so as to increase the effective length of the ball-retrieving device.

The handle-receiving means in accordance with my invention involves a molded chamber slightly larger than the end of the golf club grip, with this chamber being elongate and having a closed lower portion and a substantially open upper portion. The chamber also defines a recess having a slightly protruding shoulder, into which recess the end of the golf club grip or handle can be inserted at an angle. The substantially open upper portion is bounded by a closely spaced pair of inwardly biased, handle-contacting fingers of resilient construction, where the spacing of the fingers is less than the width of the handle or grip to be received therebetween. By virtue of this arrangement, as the end of the handle of the golf club is inserted into the recess and under the protruding shoulder, the handle can be pivoted about the shoulder for less than 90°, so as to force a part of the handle adjacent the end of the handle between the inwardly biased, resilient fingers. By spring action, the fingers will thereafter reclose around the handle portion and serve to tightly hold the handle or grip of the golf club in a substantially aligned relationship with the elongate rod. Small protuberances may be used on the upper interior portions of the fingers, which help hold the handle in close engagement with the fingers.

After the ball has been retrieved, the grip of the club can be readily removed from the chamber of the handle-receiving means and the game resumed.

My device can be manufactured at low cost, for it can be molded of an industrial grade plastic, and quite advantageously, it contains no metal parts and no moving parts. In addition, it can be easily carried in a golf bag, and may be quickly inserted onto the end of a golf club grip or handle. Because my device effectively grasps the end of the handle or grip of a golf club rather than overlapping with the handle, it can create a ball-retrieving device able to retrieve a golf ball from a relatively inaccessible location up to approximately eleven feet away from the location where the golfer is standing.

It is therefore a principal object of this invention to provide a golf ball retrieval device of simple yet highly effective construction, that can be readily inserted onto the end of a conventional golf club grip in a very tight fitting yet releasable manner, with the golf club then serving to increase the effective length of the ball retrieval device.

It is another object of this invention to provide a golf ball retrieval device of inexpensive, easily molded construction that can be readily installed upon the enlarged end of a golf club grip, with this novel device removably gripping the handle of the golf club in a tight, highly effective manner without involving a substantial overlap with the club handle, with the combined length of the golf club and the retrieval device being such as to enable a golf ball to be readily retrieved from a relatively inaccessible location.

It is yet another object of this invention to provide an inexpensive golf ball retrieval device utilizing an elongate shaft having a ball-receiving cup at one end and a molded chamber at the other end, with the molded chamber having a pair of gripping fingers that will closely yet releasably engage the enlarged end of a golf club handle, with this arrangement enabling absolutely the full length of the golf club to be utilized in increasing the effective length of the retrieval device.

It is yet still another object of this invention to provide a golf ball retrieval device of elongate construction having a ball-receiving cup at one end and a molded chamber at the other end, with the enlarged end of a golf club grip able to be readily inserted at an angle into the chamber, with the subsequent movement of the golf club handle into an aligned relationship with the retrieval device serving to lock the handle between a spaced pair of gripping fingers, with the end-to-end relationship of the retrieval device with the grip of the golf club enabling the ball-receiving cup to thereafter be utilized in a relatively forceful manner in retrieving a ball from a relatively inaccessible location without the handle or grip becoming inadvertently disengaged from the gripping fingers.

These and other objects, features and advantages will become more apparent as the description proceeds.

DETAILED DESCRIPTION

Figure 1A:
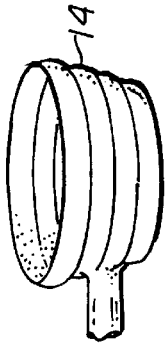
FIG. 1*a* is a perspective view of the ball-engaging cup of FIG. 1 to a somewhat larger scale, with this view revealing that the cup has tapered sidewalls made up of concentric rings.
Figure 1B:
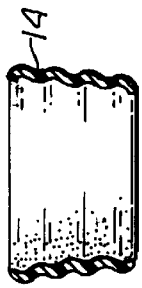
FIG. 1*b* is a cross sectional view of my novel ball-engaging cup, with this view showing the convolutions on the interior of the cup, which serve to hold the golf ball in a secure manner at a desired location.
Figure 1C:
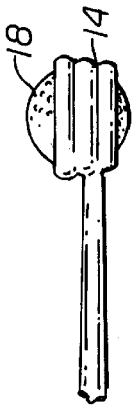
FIG. 1*c* is another view of the ball-engaging cup utilized on the end of the ball retrieval device remote from the molded chamber, with this figure revealing the approximate manner in which a golf ball that has been retrieved is retained in a secure manner in the ball-engaging cup.
Figure 1:
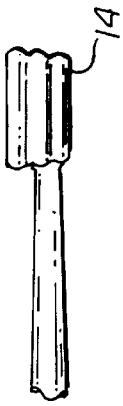
FIG. 1 is a perspective view of my novel ball retrieval device, which is readily seen to be of elongate construction and to involve at one end a ball-engaging cup, and at the other end a molded chamber having a pair of gripping fingers designed to closely yet releasably engage the enlarged end of the handle or grip of a golf club.
Figure 1:
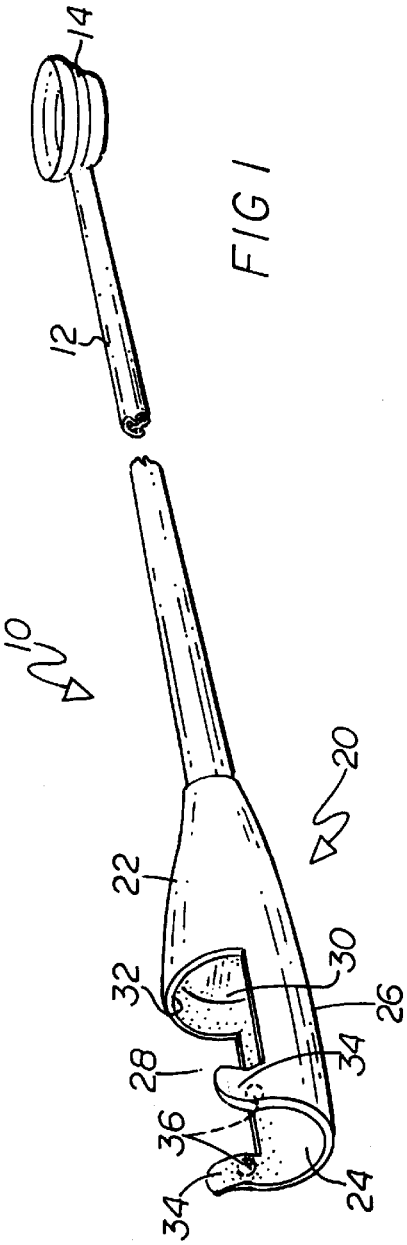

With initial reference to FIG. 1 it will be seen that I have shown a ball-retrieving device 10 for retrieving a golf ball from a location that is not easily accessible, such as shallow water or a clump of bushes. This device comprises an elongate rod 12, such as of fiberglass, having at one end, a ball-receiving cup 14. At the other end of the elongate rod is located a handle-receiving or grip-receiving means 20 for releasably engaging the end of the handle or grip of a golf club, so as to increase the effective length of the ball-retrieving device.

In FIG. 1*a* I reveal to a somewhat larger scale, the approximate configuration of the cup 14 I prefer to utilize, which will be noted to be made up of a series of concentric rings arrayed together in such a manner that the sidewalls of the cup will taper downwardly. FIG. 1*b* will be noted to be a cross sectional view of my novel ball-engaging cup, with this view showing the convolutions on the interior of the cup, which serve to hold the golf ball in a secure manner at a desired location. In FIG. 1*c* I reveal the manner in which a golf ball 18 resides in the cup 14 after retrieval. The sidewalls of the cup are somewhat flexible and because of the ribbed construction, the golf ball will be held firmly against dislodgement between the sidewalls of the cup 14.

The grip-receiving means 20 involves an enlarged portion 22, in the interior of which is defined a chamber 24 that is slightly larger than the end of the grip of a golf club. The chamber 24 is elongate and has a closed lower portion 26 and a substantially open upper portion 28. Significant to this invention is the fact that a recess 30 is defined in the inner end of the chamber 24, into which recess the somewhat enlarged upper portion of the grip of a golf club is to be closely received. As will be discussed hereinafter, an integral, relatively short shoulder 32 extends slightly outwardly above the recess 30.

On the opposite end of the chamber 24 from the recess 30 are a spaced apart pair of inwardly biased fingers 34, made of resilient material. It is to be understood that the fingers 34 are spaced apart a distance less than the width of the grip of the golf club to be received therebetween, with a degree of force being required in order to cause the fingers to move sufficiently far apart as to permit the entry of the grip portion of the club. The resilient fingers 34 are preferably of a construction integral with the other components of the enlarged portion 22, with the enlarged portion 22 preferably being molded of a suitable industrial grade plastic. The fingers 34 extend upwardly and thereafter flare outwardly, and for a reason discussed hereinafter, a protuberance 36 may be defined on an interior surface of each finger, comparatively near the end of each finger.

Figure 2:
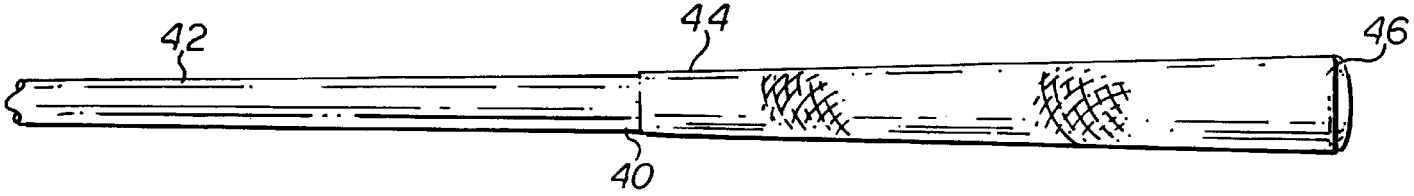
FIG. 2 is a fragmentary view of the grip or handle end of an ordinary golf club, with this view revealing that the end is somewhat enlarged.

With momentary reference to FIG. 2 it will be seen that I have here illustrated the upper portion of a conventional golf club 40, involving a portion of the shaft 42. Attached to the shaft 42 is the grip portion 44 of the golf club, with the upper end of the grip 44 being a somewhat enlarged portion 46. The aforementioned recess 30 defined in the interior end of the chamber 24 is sized to closely receive the end 46 of the golf club grip.

Figure 3:
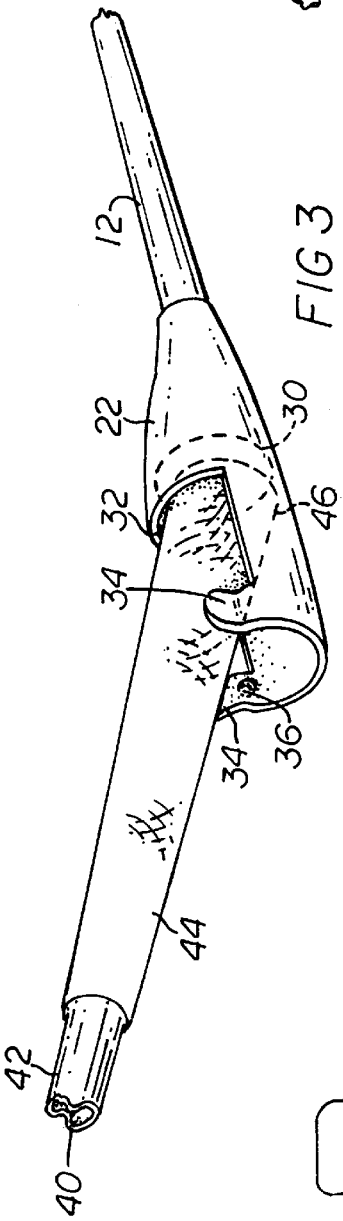
FIG. 3 is a view revealing the molded chamber portion of my novel device showing the insertion, at an angle, of the handle or grip end of the club into the molded chamber.

With reference to FIG. 3 it will be seen that I have shown the commencement of the procedure by which the grip 44 of a golf club is to be interfitted with my novel golf ball retrieving device 10. In FIG. 3 it will be noted that the somewhat enlarged end 46 of the grip 44 has been inserted at an angle into the recess 30, with a portion of the enlarged end in touching contact with the shoulder 32. At this point a portion of the grip 44 may be brought into contact with the outer ends of the fingers 34; note FIG. 3.

Now, while holding the elongate rod 12 quite firmly, the user is able to press downwardly on the grip 44 of the golf club. Quite importantly, the shoulder 32 forms a highly effective fulcrum point for the enlarged end 46 of the club grip, thus to make it possible for the user to rather easily build up the force necessary to move the fingers apart sufficiently far as to permit the grip portion to pass between the closely spaced pair of fingers 34, into the position depicted in FIG. 5. The mechanical advantage made possible by this arrangement enables the user to readily overcome the tendency of the fingers 34 to stay in a closely spaced relationship. After the grip has reached the bottom of the chamber 24, the fingers reclose around the handle of the golf club, and by a form of spring action, the grip portion 44 of the golf club is held in general alignment with the elongate rod 12 of the device 10, thus assuming the position depicted in FIG. 5.

It is thus to be seen that upon the end 46 of the grip 44 of the golf club being inserted into the recess 30 and under the protruding shoulder 32, the grip 44 can be pivoted about the shoulder for less than 90°, so as to force a part of the grip 44 adjacent the enlarged end 46 down between the inwardly biased resilient fingers 34. The retention of the grip between the fingers 34 is assisted by the presence of the protuberances 36.

Figure 6:
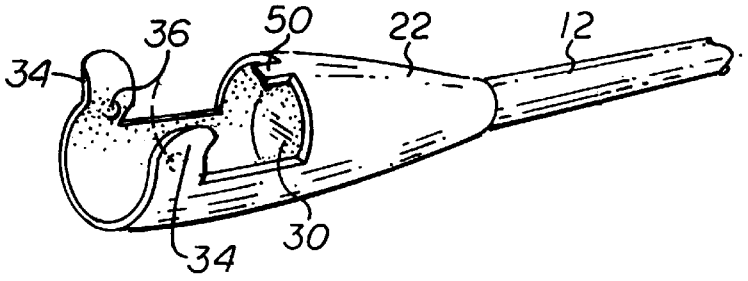
FIG. 6 is a perspective view of an alternative construction of the molded chamber portion of my retrieval device, with this embodiment of my invention utilizing a grip ejecting finger facilitating removal of the handle of the golf club from the molded chamber when the handle has been pulled away from engagement with the fingers subsequent to the retrieval of the golf ball.
Figure 4:
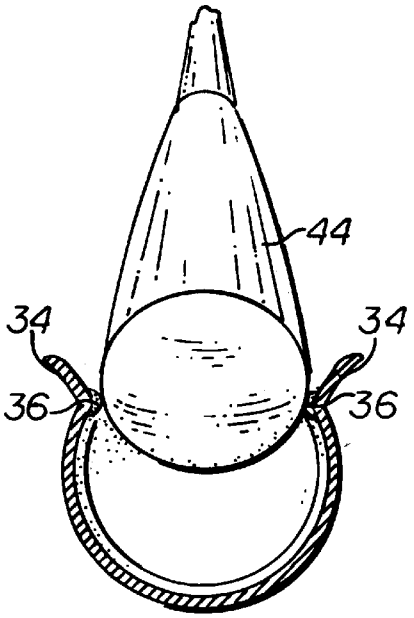
FIG. 4 is an end view closely relatable to FIG. 3 and showing how the grip of the club bears against the interior surfaces of the spaced pair of the upwardly and outwardly extending resilient fingers, causing the fingers to move apart, with the grip thereafter being tightly retained between the circular portions of the fingers.

Turning now to FIG. 6, it will be noted that I have depicted an embodiment of my invention in which an ejection finger 50 has been depicted. The ejection finger is preferably disposed on an edge of the shoulder 32, symmetrically located with respect to the fingers 34. The finger 50 is of a length to assist the removal of the golf club grip from the chamber 24 after a golf ball has been retrieved. The ejection finger typically is integral with the shoulder 32 and preferably created at the time the enlarged portion 22 is molded.

I am not to be limited to any particular procedure for constructing my novel ball retrieval device, but I may prefer to mold the enlarged portion 22 separate from the elongate rod 12. In the interests of lightness I may construct the rod so as to be hollow, but this is obviously not a requirement.

Figure 5:
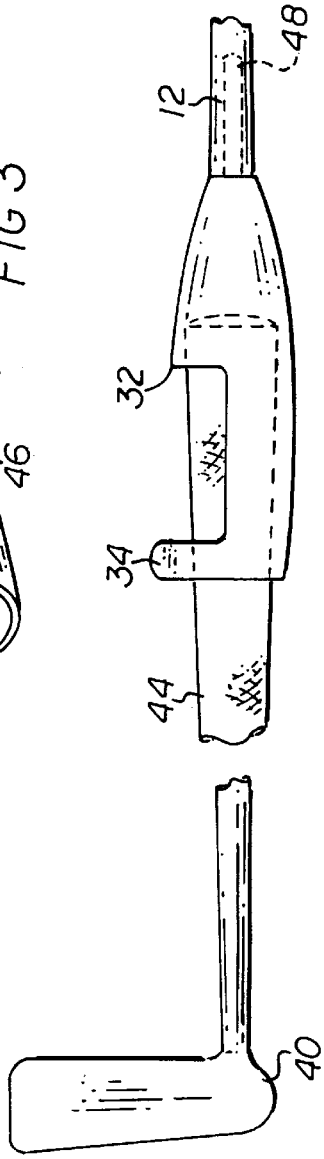
FIG. 5 is a view subsequent to the grip of the golf club having been moved into an aligned relationship with the elongate ball retrieval device in accordance with my invention, in which position the pair of fingers securely retains the golf club grip against accidental displacement.

As will be noted from FIG. 5, a relatively short shaft 48 integral with the portion 22 may protrude from the end of this portion, with the open end of the shaft 12 tightly fitted over the shaft 48 and held in place by epoxy cement or some other adhesive material. Obviously I am not to be limited to this construction.

It is therefore to be seen that I have provided a golf ball retrieval device of simple yet highly effective construction, that can be readily inserted onto the end of a conventional golf club grip in a very tight fitting yet releasable manner, with absolutely the full length of the golf club being utilized for increasing the effective length of the ball retrieval device. My novel device is of inexpensive, easily molded construction that includes a pair of resilient fingers removably gripping the handle of the golf club in a tight, highly effective manner without involving a substantial overlap with the club handle. The combined length of the golf club and the retrieval device is therefore such as to enable a golf ball to be readily retrieved from a relatively inaccessible location that may be up to approximately eleven feet away from the spot where the golfer is standing.

I claim:

1. An elongate ball-retrieving device for retrieving a golf ball from a somewhat inaccessible location, such as shallow water, said device comprising an elongate rod having at one end, a ball-receiving cup and at the other end, handle-receiving means for tightly yet releasably engaging the end of the handle of a golf club, so as to increase the effective length of the ball-retrieving device, said ball-receiving cup having upper and lower portions, with said upper portion of said ball-receiving cup being large enough to permit the entry of a golf ball, but with the lower portion of said cup being too small to permit the passage therethrough of a golf ball, said handle-receiving means involving an upwardly-opening chamber slightly larger than the end of the handle of a golf club, for releasably receiving the end of the handle of a golf club, said chamber being bounded by a closely spaced pair of inwardly biased, handle-contacting fingers of resilient construction, with the spacing between said pair of fingers being less than the width of the handle to be received therebetween, whereby upon the end of the club handle being inserted into said chamber and between said fingers, said fingers will thereafter reclose around the handle, said fingers serving to tightly hold the club handle in said chamber, in aligned relationship with said elongate device.

2. The ball-retrieving device as recited in claim 1 in which said device, including said chamber and said handle-contacting fingers, are of molded plastic.

3. A ball-retrieving device as recited in claim 1 in which said ball-receiving cup has tapered sidewalls of resilient construction, with the interior portions of said sidewalls being ribbed to facilitate ball retention.

4. An elongate ball-retrieving device adapted for being connected in an end-to-end relationship with the handle end of a golf club, such that the golf club, when moved into a substantially aligned relationship with said elongate device, can serve to increase the effective length of said elongate ball-retrieving device, one end of said elongate ball-retrieving device being equipped with a cup usable for retrieving a golf ball lodged in a relatively inaccessible location, with the end of said elongate ball-retrieving device opposite said cup having handle-receiving means for releasably engaging the end of the handle of a golf club, said cup having upper and lower portions, with said upper portion of said cup being large enough to permit the entry of a golf ball, but with the lower portion of said cup being too small to permit the passage therethrough of a golf ball, said handle-receiving means involving an upwardly-opening chamber slightly larger than the end of the handle of a golf club, said chamber being elongate and defining a recess having a slightly protruding shoulder, a closely spaced pair of inwardly biased, handle-contacting fingers of resilient construction residing adjacent said chamber in a spaced apart relationship to said recess, with the spacing between said pair of fingers being less than the width of the handle to be received therebetween, whereby upon the end of the club handle being inserted into said recess, said protruding shoulder serves as a pivot point, making it readily possible for a user to rotate the handle into firm contact with a location between said fingers, with continued handle rotation forcing said fingers apart, with the fingers thereafter reclosing around the handle, said fingers serving to hold the club handle in aligned relationship with said elongate device.

5. The ball-retrieving device as recited in claim 4 in which said device, including said chamber and said handle-contacting fingers, are of molded plastic.

6. The ball-retrieving device as recited in claim 4 in which a small protuberance is located upon an upper interior portion of each of said fingers, said protuberances assisting in maintaining the handle of the golf club in an operative position in which the handle of the golf club is substantially aligned with said elongate ball-retrieving device.

7. A ball-retrieving device as recited in claim 4 in which said ball-receiving cup has tapered sidewalls of resilient construction, with the interior portions of said sidewalls being ribbed to facilitate ball retention.

8. A ball-retrieving device as recited in claim 4 in which an ejection finger is located on an edge of said protruding shoulder, said ejection finger assisting in the removal of the handle from said chamber after a ball has been retrieved.

9. A ball-retrieving device for retrieving a golf ball from a somewhat inaccessible location, such as shallow water, said device comprising an elongate rod having at one end, a ball-receiving cup, and at the other end, handle-receiving means for releasably engaging the end of the handle of a golf club, so as to increase the effective length of the ball-retrieving device, said ball-receiving cup having upper and lower portions, with said upper portion of said ball-receiving cup being large enough to permit the entry of a golf ball, but with the lower portion of said cup being too small to permit the passage therethrough of a golf ball, said handle-receiving means involving an upwardly-opening chamber slightly larger than the end of the handle of a golf club, said chamber being elongate and having a closed lower portion and a substantially open upper portion, said chamber also defining a recess having a slightly protruding shoulder, into which recess the end of the handle of the golf club can be inserted, said substantially open upper portion being bounded by a closely spaced pair of inwardly biased, handle-contacting fingers of resilient construction, where the spacing of said fingers is less than the width of the handle to be received therebetween, with said fingers being laterally spaced from said shoulder, whereby as the end of the handle of the golf club is inserted into said recess and under said protruding shoulder, the handle can be pivoted about said recess for less than 90 degrees, so as to force a part of the handle adjacent the end of the handle between said inwardly biased resilient fingers, forcing said fingers apart, with the fingers thereafter reclosing around the handle, said fingers serving to tightly hold the handle of the golf club in a substantially aligned relationship with said elongate rod.

10. The ball-retrieving device as recited in claim 9 in which said device, including said chamber and said handle-contacting fingers, are of molded plastic.

11. The ball-retrieving device as recited in claim 9 in which a small protuberance is located upon an upper interior portion of each of said fingers, said protuberances assisting in maintaining the handle of the golf club in an operative position in which the handle of the golf club is substantially aligned with said elongate rod.

12. A ball-retrieving device as recited in claim 9 in which said ball-receiving cup has tapered sidewalls of resilient construction, with the interior portions of said sidewalls being ribbed.

13. A ball-retrieving device as recited in claim 9 in which an ejection finger is located on an edge of said protruding shoulder, said ejection finger assisting in the removal of the handle from said chamber after a ball has been retrieved.

* * * * *